US011242997B2

(12) United States Patent
Grace

(10) Patent No.: US 11,242,997 B2
(45) Date of Patent: Feb. 8, 2022

(54) PORTABLE PROPANE FUEL HEATER ASSEMBLY

(71) Applicant: K C Grace, Houston, TX (US)

(72) Inventor: K C Grace, Houston, TX (US)

( * ) Notice: Subject to any disclaimer, the term of this patent is extended or adjusted under 35 U.S.C. 154(b) by 242 days.

(21) Appl. No.: 16/568,428

(22) Filed: Sep. 12, 2019

(65) Prior Publication Data

US 2021/0080110 A1 Mar. 18, 2021

(51) Int. Cl.
*F24C 3/00* (2006.01)
*F24C 3/08* (2006.01)

(52) U.S. Cl.
CPC ..... *F24C 3/002* (2013.01); *F24C 3/082* (2013.01)

(58) Field of Classification Search
CPC .. F24C 3/082; F24C 3/14; F24C 3/004; F24C 3/002
See application file for complete search history.

(56) References Cited

U.S. PATENT DOCUMENTS 4,779,608 A 10/1988 Smith
4,848,310 A * 7/1989 Millington ..... F24C 3/14 126/4
4,891,005 A * 1/1990 Carter ..... F23Q 13/04 126/25 B
5,094,223 A 3/1992 Gonzalez
5,738,084 A * 4/1998 Hussong ..... F24B 1/1808 126/116 A
6,227,843 B1 5/2001 Pederson
6,311,687 B1 11/2001 Aidelsburger
6,843,244 B2 1/2005 McCalley
7,047,963 B2 5/2006 Van Vleet
9,086,220 B2 7/2015 Husted
93,164,041 4/2016 Guste
2003/0188735 A1 10/2003 Yang
2006/0054160 A1 3/2006 Borowske
2007/0044790 A1* 3/2007 Carlo ..... F24C 3/004 126/512

FOREIGN PATENT DOCUMENTS

WO WO2009049047 4/2009

* cited by examiner

*Primary Examiner* — Alfred Basichas

(57) ABSTRACT

A portable propane fuel heater assembly for heating a room with propane fuel includes a fuel tank that contains liquid propane. A supply hose is fluidly coupled to the fuel tank for receiving gaseous propane from the liquid propane. A heater is provided and the heater is positionable in a room in a building. The supply hose is fluidly coupled to the heater thereby facilitating the heater to receive the gaseous propane that gaseous propane from the liquid propane. In this way the heater can burn the gaseous propane for heating the room in the building. Additionally, the heater has an exhaust duct for venting combustion gases outwardly from the heater.

8 Claims, 5 Drawing Sheets

PORTABLE PROPANE FUEL HEATER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to heater devices and more particularly pertains to a new heater device for heating a room with propane fuel.

(2) Description of Related Art Including Information Disclosed Under 37 CFR 1.97 and 1.98

The prior art relates to heater devices.

BRIEF SUMMARY OF THE INVENTION

An embodiment of the disclosure meets the needs presented above by generally comprising a fuel tank that contains liquid propane. A supply hose is fluidly coupled to the fuel tank for receiving gaseous propane from the liquid propane. A heater is provided and the heater is positionable in a room in a building. The supply hose is fluidly coupled to the heater thereby facilitating the heater to receive the gaseous propane that gaseous propaned from the liquid propane. In this way the heater can burn the gaseous propane for heating the room in the building. Additionally, the heater has an exhaust duct for venting combustion gases outwardly from the heater.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
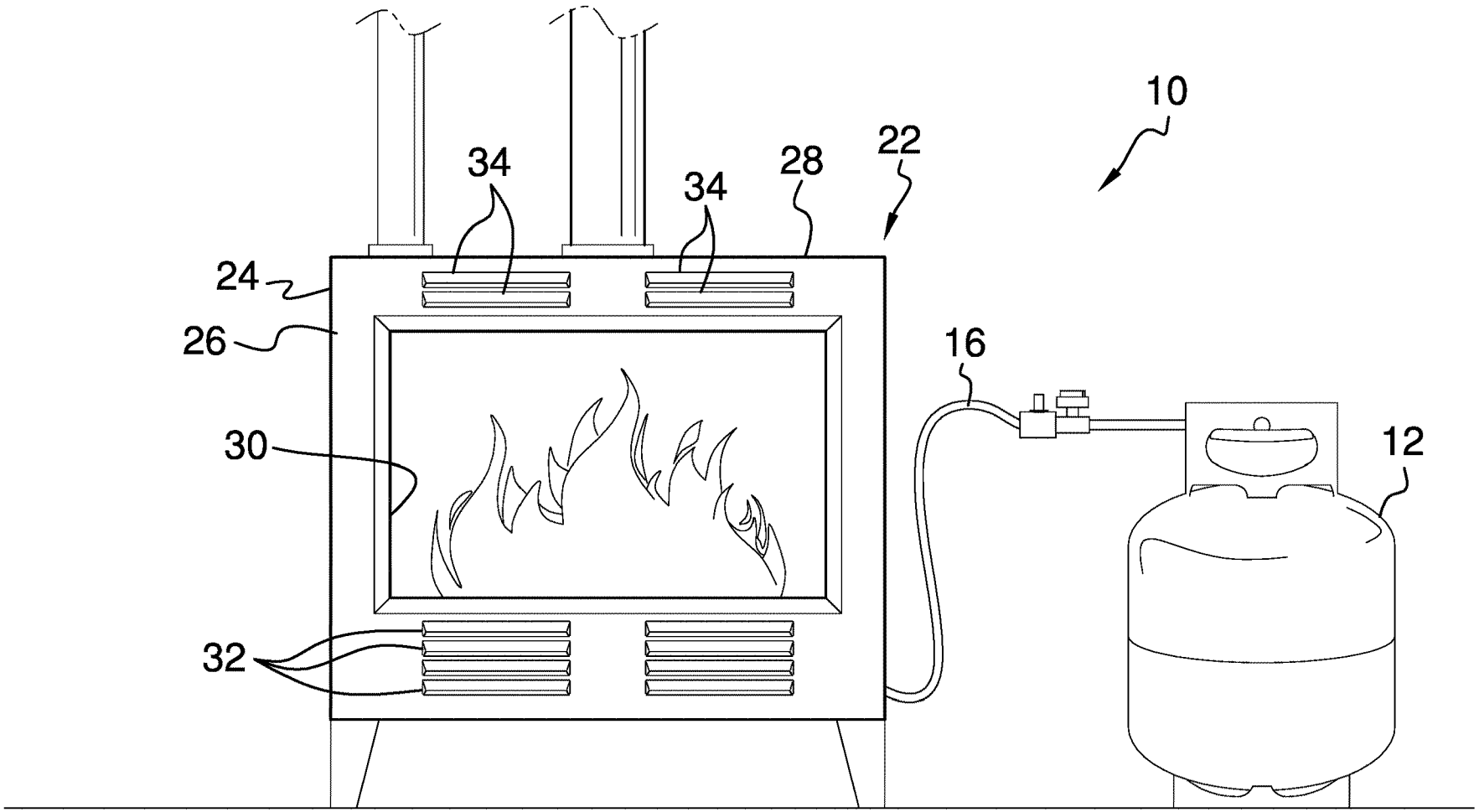
FIG. 1 is a front in-use view of a portable propane fuel heater assembly according to an embodiment of the disclosure.
Figure 2:
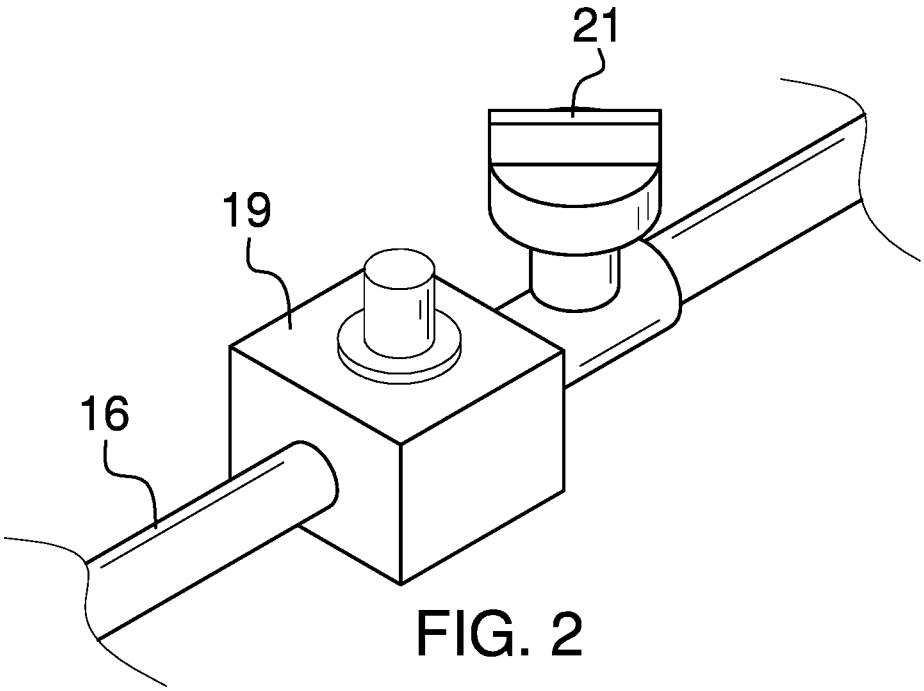
FIG. 2 is a perspective view of supply hose of an embodiment of the disclosure.
Figure 3:
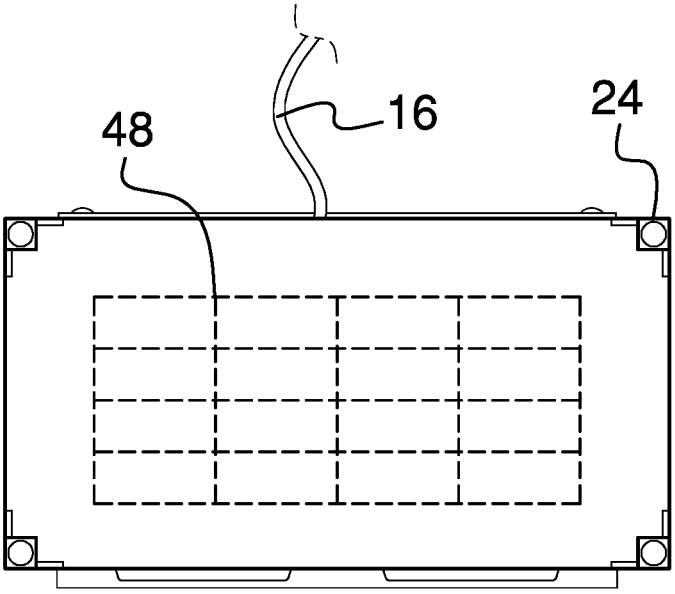
FIG. 3 is a bottom phantom view of an embodiment of the disclosure.
Figure 4:
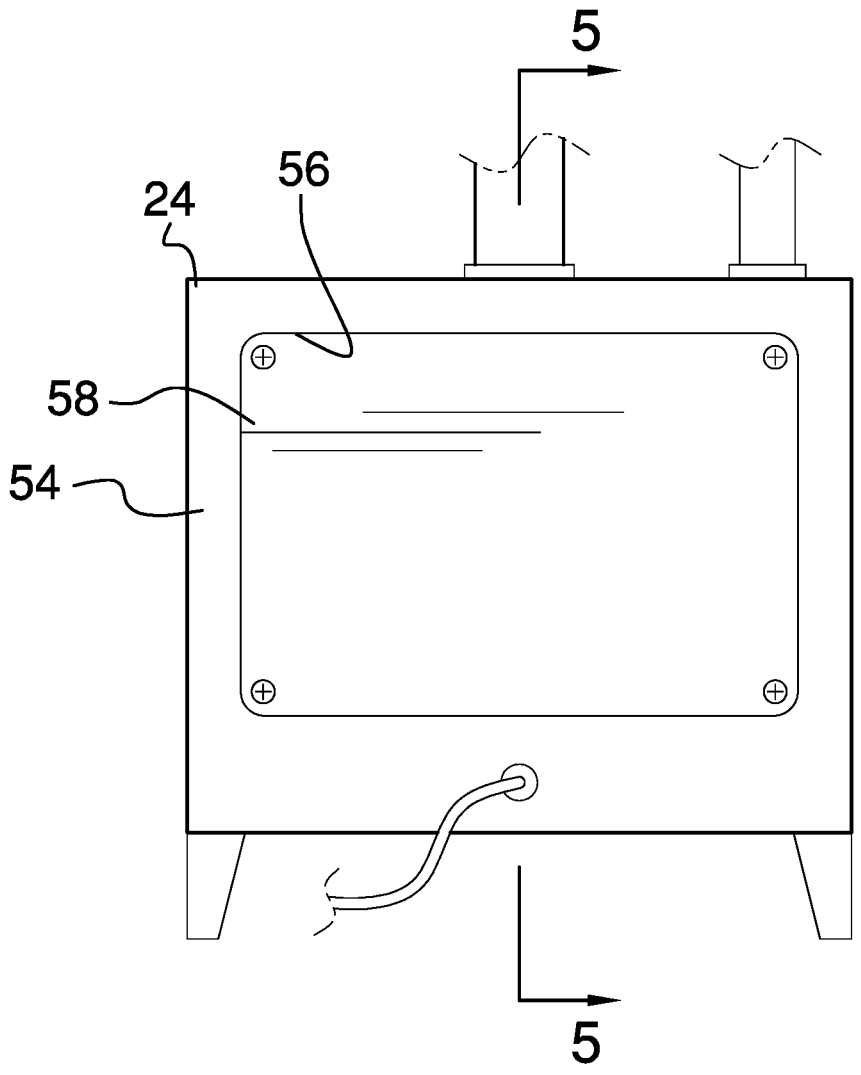
FIG. 4 is a back view of an embodiment of the disclosure.
Figure 5:
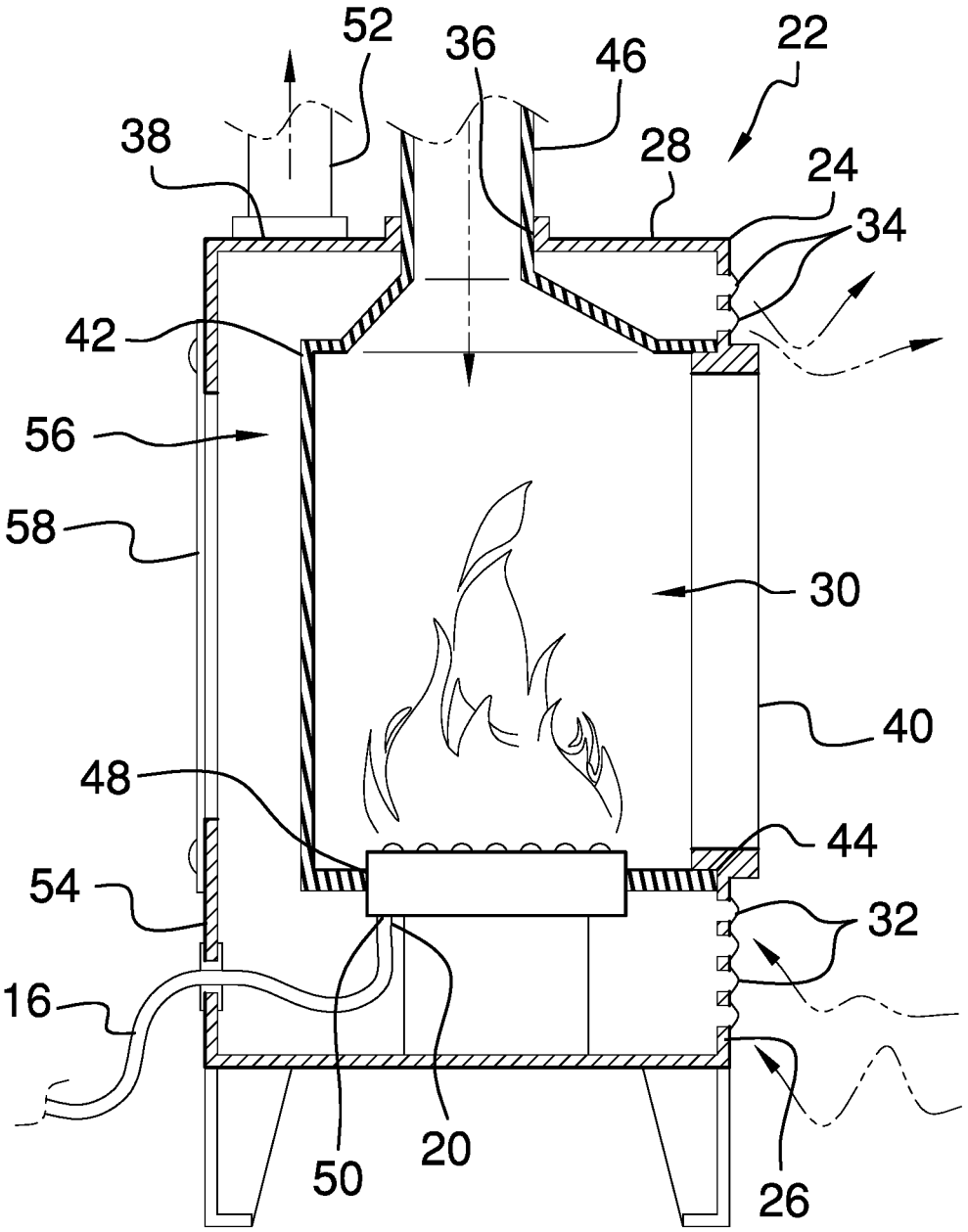
FIG. 5 is a cross sectional view taken along line 5-5 of FIG. 4 of an embodiment of the disclosure.
Figure 6:
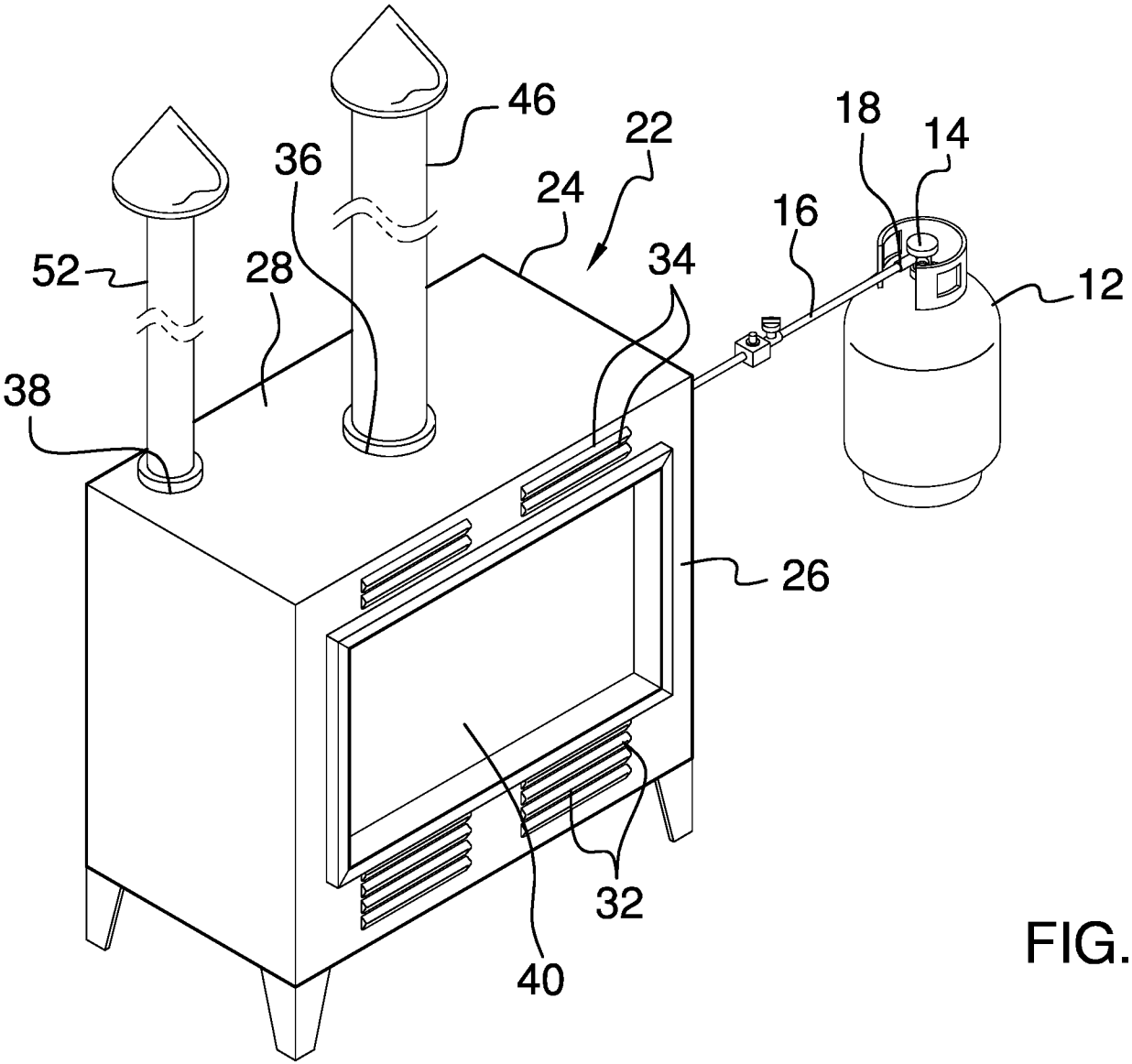
FIG. 6 is a perspective in-use view of an embodiment of the disclosure.

With reference now to the drawings, and in particular to FIGS. 1 through 6 thereof, a new heater device embodying the principles and concepts of an embodiment of the disclosure and generally designated by the reference numeral 10 will be described.

As best illustrated in FIGS. 1 through 6, the portable propane fuel heater assembly 10 generally comprises a fuel tank 12 for containing liquid propane. The fuel tank 12 has an outlet 14, and the fuel tank 12 may be a 20.0 pound propane tank or the like. A supply hose 16 is provided and the supply hose 16 is fluidly coupled to the fuel tank 12 for receiving gaseous propane from the liquid propane. The supply hose 16 has a first end 18 and a second end 20, and the first end 18 is removably coupled to the outlet 14 of the fuel tank 12. The supply hose 16 may include gas flow regulator 19 that is approved for use with liquid propane gas, a shut off valve 21 and other safety devices that are required by law.

A heater 22 is provided and the heater 22 is positionable in a room in a building. The supply hose 16 is fluidly coupled thereto thereby facilitating the heater 22 to receive the gaseous propane that has evaporated from the liquid propane. In this way the heater 22 can burn the gaseous propane for heating the room in the building. Additionally, the heater 22 facilitates the room to be heated when neither natural gas heat nor electric heat are available.

The heater 22 comprises a housing 24 that has a front wall 26 and a top wall 28. The front wall 26 has a front opening 30 extending into an interior of the housing 24. The front wall 26 has a plurality of intake vents 32 each extending into the interior of the housing 24 to pass air into the housing 24. Each of the intake vents 32 is positioned beneath the front opening 30. The front wall 26 has a plurality of exhaust vents 34 each extending into the interior of the housing 24 to pass air outwardly from the housing 24. The plurality of exhaust vents 34 is positioned above the front opening 30. The top wall 28 has an intake opening 36 extending into the interior of the housing 24 and the top wall 28 has an exhaust opening 38 extending into the interior of the housing 24.

A window 40 is coupled to the front wall 26 of the housing 24 and the window 40 is positioned over the front opening 30. The window 40 may be a window approved for use with an open flame, such as would be found on an oven door or the like. A heat box 42 is positioned within the housing 24. The heat box 42 has a forward side 44, the forward side 44 is open and the forward side 44 is aligned with the window 40. The heat box 42 has an intake 46 extending upwardly through the intake opening 36 in the top wall 28 of the housing 24. The intake 46 is open to pass air into the heat box 42 to facilitate combustion within the heat box 42. Moreover, the heat box 42 is comprised of a thermally conductive material such that the heat box 42 is in thermal communication with the interior of the housing 24.

A burner 48 is coupled to the heat box 42 and the burner 48 has an inlet 50. The second end 20 of the supply hose 16 is fluidly coupled to the inlet 50 thereby facilitating the burner 48 to burn the gaseous propane from the liquid propane in the fuel tank 12. The burner 48 heats the heat box 42 when the burner 48 burns the gaseous propane. In this way the heat box 42 heats the interior of the housing 24 when the heat box 42 is heated thereby facilitating the heater 22 to heat the room. The air that passes into the housing 24 through each of the intake vents 32 is heated, and subsequently passes outwardly through the exhaust vents 34 for heating the room. The burner 48 may include an electronic ignitor for lighting the burner 48.

An exhaust duct 52 is coupled to the top wall 28 of the housing 24. The exhaust duct 52 extends through the exhaust opening 38 in the top wall 28 of the housing 24. Additionally, the exhaust duct 52 is in fluid communication with the heat box 42. In this way the exhaust duct 52 can ventilate combustion gases from the heat box 42. A back wall 54 of the housing 24 may have an access opening 56 extending into the interior of the housing 24. A cover 58 may be removably coupled to the back wall 54 to cover to access opening 56.

In use, the heater 22 is brought into the room when neither natural gas heat nor electric heat is available in the room. The supply hose 16 is fluidly coupled to the outlet 14 of the fuel tank 12 to direct the gaseous propane from the liquid propane into the burner 48. The burner 48 burns the gaseous propane in the heat box 42 and subsequently heats the heat box 42. In this way the heat box 42 heats the air within the housing 24 for heating the room. Additionally, the exhaust duct 52 can be routed to ventilate the combustion gasses through a window 40 or to any desired location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable propane fuel heater assembly being configured to heat a room where natural gas heat or electric heat are not available, said assembly comprising:

a fuel tank containing liquid propane, said fuel tank having an outlet;

a supply hose being fluidly coupled to said fuel tank for receiving gaseous propane that has evaporated from the liquid propane, said supply hose having a first end and a second end, said first end being removably coupled to said outlet of said fuel tank;

a heater being positionable in a room in a building, said supply hose being fluidly coupled to said heater thereby facilitating said heater to receive the gaseous propane from the liquid propane wherein said heater is configured to burn the gaseous propane for heating the room in the building, said heater having an exhaust duct for venting combustion gases outwardly from said heater;

wherein said heater comprises a housing having a front wall and a top wall;

wherein said front wall has a front opening extending into an interior of said housing;

wherein said front wall has a plurality of intake vents each extending into said interior of said housing wherein said intake vents are configured to pass air into said housing, each of said intake vents being positioned beneath said front opening;

wherein said front wall has a plurality of exhaust vents each extending into said interior of said housing wherein said plurality of exhaust vents is configured to pass air outwardly from said housing, said plurality of exhaust vents being positioned above said front opening;

wherein said top wall has an intake opening extending into said interior of said housing; and wherein said top wall has an exhaust opening extending into said interior of said housing.

2. The assembly according to claim 1, further comprising a window being coupled to said front wall of said housing, said window being positioned over said front opening.

3. The assembly according to claim 2, further comprising a heat box being positioned within said housing, said heat box having a forward side, said forward side being open, said forward side being aligned with said window.

4. The assembly according to claim 3, Wherein said heat box has an intake extending upwardly through said intake opening in said top wall of said housing, said intake being open wherein said intake is configured to pass air into said heat box.

5. The assembly according to claim 4, wherein said heat box is comprised of a thermally conductive material such that said heat box is in thermal communication with said interior of said housing.

6. The assembly according to claim 5, further comprising a burner being coupled to said heat box, said burner having an inlet, said second end of said supply hose being fluidly coupled to said inlet thereby facilitating said burner to burn the gaseous propane from the liquid propane in said fuel tank, said burner heating said heat box when said burner burns the gaseous propane, said heat box heating said interior of said housing when said heat box is heated wherein said heater is configured to heat the room.

7. The assembly according to claim 3, further comprising an exhaust duct being coupled to said top wall of said housing, said exhaust duct extending through said exhaust opening in said top wall of said housing, said exhaust duct being in fluid communication with said heat box wherein said exhaust duct is configured to ventilate combustion gases from said heat box.

8. A portable propane fuel heater assembly being configured to heat a room where natural gas heat or electric heat are not available, said assembly comprising:

a fuel tank containing liquid propane, said fuel tank having an outlet;

a supply hose being fluidly coupled to said fuel tank for receiving gaseous propane from the liquid propane, said supply hose having a first end and a second end, said first end being removably coupled to said outlet of said fuel tank; and a heater being positionable in a room in a building, said supply hose being fluidly coupled to said heater thereby facilitating said heater to receive gaseous propane that has evaporated from the liquid propane wherein said heater is configured to burn the gaseous propane for heating the room in the building, said heater comprising:

a housing having a front wall and a top wall, said front wall having a front opening extending into an interior of said housing, said front wall having a plurality of intake vents each extending into said interior of said housing wherein said intake vents are configured to pass air into said housing, each of said intake vents being positioned beneath said front opening, said front wall having a plurality of exhaust vents each extending into said interior of said housing wherein said plurality of exhaust vents is configured to pass air outwardly from said housing, said plurality of exhaust vents being positioned above said front opening, said top wall having an intake opening extending into said interior of said housing, said top wall having an exhaust opening extending into said interior of said housing;

a window being coupled to said front wall of said housing, said window being positioned over said front opening;

a heat box being positioned within said housing, said heat box having a forward side, said forward side being open, said forward side being aligned with said window, said heat box having an intake extending upwardly through said intake opening in said top wall of said housing, said intake being open wherein said intake is configured to pass air into said heat box, said heat box being comprised of a thermally conductive material such that said heat box is in thermal communication with said interior of said housing; and a burner being coupled to said heat box, said burner having an inlet, said second end of said supply hose being fluidly coupled to said inlet thereby facilitating said burner to burn the gaseous propane from the liquid propane in said fuel tank, said burner heating said heat box when said burner burns the gaseous propane, said heat box heating said interior of said housing when said heat box is heated wherein said heater is configured to heat the room; and an exhaust duct being coupled to said top wall of said housing, said exhaust duct extending through said exhaust opening in said top wall of said housing, said exhaust duct being in fluid communication with said heat box wherein said exhaust duct is configured to ventilate combustion gases from said heat box.

* * * * *